US006579571B2

(12) United States Patent
Horikawa et al.

(10) Patent No.: US 6,579,571 B2
(45) Date of Patent: Jun. 17, 2003

(54) METHOD FOR PRODUCING ELECTRON TUBE

(75) Inventors: Akihiro Horikawa, Osaka (JP); Tsumoru Ohata, Kyoto (JP); Tatsuo Mifune, Katano (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/908,714

(22) Filed: Jul. 20, 2001

(65) Prior Publication Data

US 2002/0031611 A1 Mar. 14, 2002

Related U.S. Application Data

(62) Division of application No. 09/250,169, filed on Feb. 16, 1999, now Pat. No. 6,333,595.

(30) Foreign Application Priority Data

Feb. 16, 1998 (JP) ..... 10-032451
Oct. 28, 1998 (JP) ..... 10-306200

(51) Int. Cl.[7] ..... B05D 1/02
(52) U.S. Cl. ..... 427/421
(58) Field of Search ..... 427/421, 422, 427/424, 426, 428, 233, 236; 118/300–326; 239/3, 4, 2, 690–708; 222/1, 590–607; 901/43

(56) References Cited

U.S. PATENT DOCUMENTS

| | | | | |
|---|---|---|---|---|
| 3,814,322 A | | 6/1974 | Waldrum | 239/251 |
| 4,567,111 A | * | 1/1986 | Janikowski et al. | 428/457 |
| 4,983,136 A | | 1/1991 | Okuda | 445/47 |
| 5,192,197 A | * | 3/1993 | Culp | 417/322 |
| 5,226,962 A | * | 7/1993 | Burke et al. | 118/74 |
| 5,429,682 A | * | 7/1995 | Harlow, Jr. et al. | 118/681 |
| 5,743,960 A | * | 4/1998 | Tisone | 118/683 |
| 5,916,524 A | * | 6/1999 | Tisone | 422/100 |
| 5,996,650 A | * | 12/1999 | Phallen et al. | 141/83 |
| 6,276,589 B1 | * | 8/2001 | Watts, Jr. et al. | 228/33 |

FOREIGN PATENT DOCUMENTS

| | | | |
|---|---|---|---|
| EP | 0 665 572 A1 | 1/1995 | H01J/9/14 |
| JP | 09083120 | 7/1997 | |
| JP | 09262525 | 10/1997 | |
| WO | WO 98/03267 * | 1/1998 | |

* cited by examiner

*Primary Examiner*—Michael Barr
*Assistant Examiner*—Eric B Fuller
(74) *Attorney, Agent, or Firm*—Parkhurst & Wendel, L.L.P.

(57) ABSTRACT

It is an object of the present invention to present a method for producing an electron tube capable of preventing agglomeration of particles contained in coating material to be coated on an shadow mask to form an electron beam reflecting film, that causes settling of the particles on a shadow mask or clogging of the coating system, and fluctuations of pressure for supplying the coating material to a spray nozzle, that cause unstable quantity by weight of the coating material discharged from the nozzle and excessive coating, thereby preventing deterioration of the quality of images. An electron beam reflecting film of high surface coverage can be formed for the electron tube with a small quantity by weight of the coating material containing bismuth oxide particles which have an average particle diameter D50 of 0.6 μm or less and a particle size distribution with the particles having a diameter between D40 and D60 accounting for at least 20% by volume of the total particles. This method supplies the coating material by oscillations of a piezoelectric element to the spray nozzle, or scans the nozzle just by slanting the nozzle at varying angles while keeping a head between the surface of the coating material in a coating material storage section and the nozzle center.

8 Claims, 9 Drawing Sheets

A
B
C
P
O
h
10
16
17
18
19
20

METHOD FOR PRODUCING ELECTRON TUBE

This is a Division of application Ser. No. 09/250,169 filed Feb. 16, 1999, now U.S. Pat. No. 6,333,595 B1.

FIELD OF THE INVENTION

The present invention relates to a method for producing an electron tube equipped with a shadow mask for TV sets or computers.

BACKGROUND OF THE INVENTION

One of the conventional methods for producing an electron tube is disclosed by Japanese Patent Application Laid-Open No. 59-94325. FIG. 1 illustrates a structure of electron tube, wherein 1 is a shadow mask, 1*a* is the shadow mask side facing an electron gun, 2 is an electron gun, 3 is a fluorescent plane, 4 are electron beams, and 5 is an electron tube. The shadow mask made of a metallic material is provided with a number of openings, and is designed to match with the fluorescent plane. When the electron tube is switched on, the electron beams issued by the electron gun pass through the beam-transmitting openings to hit the fluorescent plane, generating desired images thereon.

Most of the electrons, however, hit the shadow mask without passing the openings, with the result that energy of motion of the electrons is transmitted as thermal energy to the shadow mask, to heat it to 70° C. or higher. This temperature rise thermally expands the shadow mask to cause misalignment between the opening sections in the shadow mask and fluorescent plane, causing problems, e.g., color shift and lowered brightness. The problematic phenomenon of thermal expansion of the shadow mask caused by shooting electron beams is referred to as doming.

It is known that these problems are controlled by coating the shadow mask side 1*a* facing the electron gun with a coating material containing an element having an atomic number of 70 or more to form an electron beam reflecting film. In particular, the coating material containing powdered bismuth oxide or the like is considered to be suitable, because of its effect of efficiently reflecting the electron beams (hereinafter referred to as electron-reflecting effect). It is also known that an element having a larger atomic number shows a larger electron-reflecting effect. Therefore, the shadow mask side 1*a* is coated with a coating material containing a material of large electron-reflecting effect, such as powdered bismuth oxide, to reflect the electron beams that hit the shadow mask. The electron beam reflecting film is generally formed by spraying, in which the electron beam reflecting coating material is supplied by a high-capacity pump, e.g., magnet pump, to a nozzle to prevent settling of the coating material in the nozzle and piping systems, and the nozzle is scanned over the shadow mask to form the film. The electron beam reflecting film formed on the shadow mask side facing the electron gun prevents temperature rise of the shadow mask, and thereby to solve the problems, such as color shift, caused by doming.

The surface coat is formed by spreading a surface coating material, such as that containing $SiO_2$ or ITO, to realize a low-reflection function and anti-static function by resultant difference in refractive index and its conductivity. The coating material is spread by spraying or spin coating, the latter being a normal choice, because of difficulty of the former to give a dense, homogeneous coating film.

A common method for producing the coating material for electron beam reflecting films is dispersion by a rotating device, such as a ball mill. However, the coating material dispersed by this method tends to suffer secondary agglomeration, after it is dispersion-treated, which causes problems, e.g., settlement of the coating material in, and clogging of, the coating systems, making it difficult to inject the coating material stably from the nozzle and to form a dense, homogeneous electron beam reflecting film. Another dispersion method uses a sand mill. The method using such a medium, however, has disadvantages, e.g., breakdown of the medium itself in a dispersion machine to contaminate the coating material, and unstable dispersion conditions of the coating material, because of newly evolved interfaces as a result of destruction of coating material particle shapes.

Moreover, the conventional coating material for electron beam reflecting films contains particles of large average size and unstable particle size distribution. In order to secure a high surface coverage of the electron beam reflecting film, it is necessary to spread a large quantity of the coating material over the shadow mask side, to 0.2 mg/cm$^2$ or more, as disclosed by Japanese Patent Application Laid-Open No. 59-94325. As a result, the film tends to come off from the shadow mask in the electron tube product, causing problems, e.g., contamination within the electron tube and lowered image quality.

The method for forming an electron beam reflecting film by spraying supplies the coating material to the nozzle and recycles it by a high-capacity pump, e.g., a magnet pump. This method, however, involves problems, e.g., adverse effects of fluctuating pump discharge pressure on discharge conditions of the coating material at the nozzle, causing uneven coating as a result of fluctuations in quantities discharged from the nozzle and making it difficult to form a dense, homogeneous electron beam reflecting film. Moreover, a head (level difference) between the surface of the stored coating material and the nozzle changes as the coating material is spread over the shadow mask. This causes a change in pressure for supplying the coating material to the nozzle and therefore a change in quantity of the coating material discharged from the nozzle. This also causes uneven coating and makes it difficult to form a dense, homogeneous electron beam reflecting film.

Denser coating is needed for forming a surface coat over a glass panel surface by spraying, so that the surface coat can exhibit a low-reflection function and anti-static function. The conventional spraying method, however, tends to form an uneven film, and difficult to realize the surface coat exhibiting sufficient functions. The spin coating for surface coat has disadvantages such as low coating efficiency and high cost.

DISCLOSURE OF THE INVENTION

It is an object of the present invention to provide a method for forming a good electron tube by forming a dense, homogeneous electron beam reflecting film to control the doming phenomenon and thereby to solve the problems that cause deteriorated image quality. It is another object of the present invention to provide a method for forming a good electron tube by forming a dense, homogeneous electron beam reflecting film by spraying which presents high coating efficiency and is relatively low in cost.

The invention of claim 1 is a coating material dispersed with bismuth oxide, wherein an average particle diameter D50 of the bismuth oxide particles is 0.6 $\mu$m or less, and particles having a diameter between D40 and D60 in a particle size distribution accounts for 20% or more in volume of the total particles. Because the particle size of bismuth oxide scatters little, a dense electron beam reflecting film with high surface coverage can be formed even with a small quantity by weight of the coating material.

The invention of claim 2 is a coating material dispersed with bismuth oxide using water as a solvent, wherein an average particle diameter D50 of the bismuth oxide particles is 0.6 $\mu$m or less, and particles having a diameter between D40 and D60 in a particle size distribution accounts for 20% or more in volume of the total particles. For the same reason as described above, a dense electron beam reflecting film with high surface coverage can be formed even with a small quantity by weight of the coating material.

The invention of claim 3 is a coating material dispersed with bismuth oxide using water as a solvent and water glass as a binder, wherein an average particle diameter D50 of the bismuth oxide particles is 0.6 $\mu$m or less, and particles having a diameter between D40 and D60 in a particle size distribution accounts for 20% or more in volume of the total particles. For the same reason as described above, a dense electron beam reflecting film with high surface coverage can be formed even with a small quantity by weight of the coating material.

The invention of claim 4 is a coating material dispersed with bismuth oxide using ethanol or methanol as a solvent, wherein an average particle diameter D50 of the bismuth oxide particles is 0.6 $\mu$m or less, and particles having a diameter between D40 and D60 in a particle size distribution accounts for 20% or more in volume of the total particles. For the same reason as described above, a dense electron beam reflecting film with high surface coverage can be formed even with a small quantity by weight of the coating material.

The invention of claim 5 is a coating material dispersed with bismuth oxide using ethanol or methanol as a solvent and alcoholate of silica as a binder, wherein an average particle diameter D50 of the bismuth oxide particles is 0.6 $\mu$m or less, and particles having a diameter between D40 and D60 in a particle size distribution accounts for 20% or more in volume of the total particles. For the same reason as described above, a dense electron beam reflecting film with high surface coverage can be formed even with a small quantity by weight of the coating material.

The invention of claim 6 is the coating material described in any one of claims 1 to 5, wherein the content of solids is 20% or less. With this, a dense electron beam reflecting film with high surface coverage can be formed without causing clogging of openings or liquid dripping.

The invention of claim 7 is an electron tube having a shadow mask of which plane to be irradiated with electron beams is coated with the coating material according to any one of claims 1 to 6. With this, high-quality images can be presented because the dense electron beam reflecting film with high surface coverage can be formed to exhibit a sufficient doming-control effect even with a small quantity by weight of the coating material.

The invention of claim 8 is an electron tube having shadow mask of which plane to be irradiate with electron beams is coated with no more than 0.2 mg/cm$^2$ by weight of the coating material according to any one of claims 1 to 6. With this, high-quality images can be presented because the dense electron beam reflecting film with high surface coverage can be formed to exhibit a sufficient doming-control effect even with a small quantity by weight of the coating material.

The invention of claim 9 is an electron tube having shadow mask which is coated with the coating material according to any one of claims 1 to 6 in order to form thereon an electron beam reflecting film having a surface coverage of 40% or more. With this, high-quality images can be presented because the dense electron beam reflecting film with high surface coverage can be formed to exhibit a sufficient doming-control effect even with a small quantity by weight of the coating material.

The invention of claim 10 is an electron tube having a shadow mask of which plane to be irradiated with electron beams is coated with the coating material according to any one of claims 1 to 6 after dispersing the coating material by an agitator operating at a circumferential velocity of 30 m/s or more. With this, high-quality images can be presented because the dense electron beam reflecting film with high surface coverage can be formed to exhibit a sufficient doming-control effect even with a small quantity by weight of the coating material.

The invention of claim 11 is a coating method employing a device having a nozzle disposed to face a to-be-coated plane so that a coating material is coated over the plane by scanning the nozzle, characterized in that the coating material is supplied to the nozzle by means of a piezoelectric pump utilizing oscillations of a piezoelectric element provided therein. This method realizes stable coating by supplying the coating material to the nozzle by a precise, fine oscillations of the piezoelectric element, thereby causing little pulsation of the coating material being discharged.

The invention of claim 12 is a coating method employing a device having a nozzle disposed to face a to-be-coated plane so that a coating material is coated over the plane by scanning the nozzle, wherein a piezoelectric element is actuated at an oscillation frequency of 20 Hz or more, and thus generated oscillations are utilized to supply the coating material to the nozzle. Utilization of high-frequency oscillations of the piezoelectric element allows control of fluctuations of pressure for supplying the coating material and stable discharge of the coating material from the nozzle.

The invention of claim 13 is a coating method employing a device having a nozzle disposed to face a to-be-coated plane so that a coating material is coated over the plane by scanning the nozzle, wherein the coating is effected by slanting the nozzle at varying angles without varying a head (level difference) between the surface of the coating material in a coating material storage section and the nozzle center. When a large area is to be coated, keeping the head constant makes it possible to keep constant the pressure for supplying the coating material to the nozzle, and to stably discharge the coating material from the nozzle, thereby minimizing the scatter of the coated material by weight.

The invention of claim 14 is a coating method employing a device having a nozzle disposed to face a to-be-coated plane so that a coating material is coated over the plane by scanning the nozzle, wherein the coating material is supplied to the nozzle by a piezoelectric pump utilizing oscillations of a piezoelectric element, wherein the coating is effected by slanting the nozzle at varying angles without varying a head (level difference) between the surface of the coating material in a coating material storage section and the nozzle center. Accurate supply of the coating material by means of the piezoelectric element secures a stabled discharge quantity of the coating material from the nozzle. In addition, when a large area is to be coated, keeping the head constant makes it possible to keep constant the pressure for supplying the coating material to the nozzle, and to stably discharge the coating material from the nozzle, thereby minimizing the scatter of the coated material by weight.

The invention of claim 15 is a coating method employing a device having a nozzle disposed to face a to-be-coated plane so that a coating material is coated over the plane by scanning the nozzle, wherein a piezoelectric pump and the nozzle are assembled integratedly such that the center level of the piezoelectric pump becomes identical with that of the nozzle, and the coating is effected by simply scanning the nozzle without varying the positional relation between the piezoelectric pump and the nozzle. This method realizes stable discharge of the coating material from the nozzle by controlling fluctuations of pressure for supplying the coating material, said fluctuations being caused by changes in distance or positional relation between the nozzle and piezoelectric pump, so that the coating material can be accurately supplied to the nozzle.

The invention of claim 16 is a coating method employing a device having a nozzle disposed to face a to-be-coated plane so that a coating material is coated over the plane by scanning the nozzle, wherein the coating is effected (a) by slanting the nozzle at varying angles without varying a head (level difference) between the surface of the coating material in a coating material storage section and the nozzle center by scanning the nozzle only in the horizontal direction in parallel to the plane, or by (b) slanting the nozzle while supplying the coating material to the nozzle by a piezoelectric pump, or by (c) integratedly assembling the piezoelectric pump and the nozzle such that the centers of the piezoelectric pump and the nozzle become identical in order to scan the nozzle without varying the positional relation between the two, thereby slanting the nozzle while supplying the coating material to the nozzle by the piezoelectric pump without varying the head between the surface of the coating material in the coating material storage section and the nozzle center. As a result, precise coating can be realized because the coating material can be accurately supplied to the nozzle and the discharge of the coating material from the nozzle can be stabled by controlling fluctuations of pressure for supplying the coating material to the nozzle that may be caused by vertical motion of the nozzle.

The invention of claim 17 is a coating method employing a device having a nozzle disposed to face a to-be-coated plane so that a coating material is coated over the plane by scanning the nozzle, wherein the coating material is supplied to the nozzle by a piezoelectric element operating at a frequency of at least 20 Hz, while controlling pressure of the coating material supplied to the nozzle by opening of a precision valve installed in a coating material recycling line, or wherein the nozzle is scanned only in the horizontal direction in parallel to the plane, while it is slanted at varying angles without varying a head between the surface of the coating material in the coating material storage section and the nozzle center, or wherein the coating material is supplied to the nozzle by a piezoelectric pump, while the nozzle is slanted at varying angles without varying the head between the surface of the coating material in the coating material storage section and the nozzle center, or wherein the coating material is supplied to the nozzle by a piezoelectric pump, while the nozzle is slanted at varying angles without varying the head between the surface of the coating material in the coating material storage section and the nozzle center, thereby keeping a constant positional relation between the piezoelectric pump and the nozzle by integratedly assembling them such that the centers of the piezoelectric pump and the nozzle become identical. As a result, precise coating can be realized because the coating material can be accurately supplied to the nozzle and the discharge of the coating material from the nozzle can be stabled by precise control, without being affected by pump flow characteristics and the like.

The invention of claim 18 is the coating method according to any one of claims 11 to 17, wherein the nozzle is a spray nozzle. This spray method realizes precise control of pressure for supplying the coating material to the spray nozzle without being affected by pump flow characteristics and the like, thereby enabling stabled discharge of the coating material from the nozzle.

The invention of claim 19 provides a method for producing an electron tube having a shadow mask, characterized in that the shadow mask is coated with a coating material for foring an electron beam reflecting film over the shadow mask by any one of the methods described in claims 11 to 18. This method enables it to form dense, homogeneous electron beam reflecting films by precisely supplying the coating material to the nozzle while controlling fluctuations of pressure for supplying the coating material to the nozzle, thereby securing high-quality images.

The invention of claim 20 provides a method for producing an electron tube by spreading a surface coating material over the surface of a glass panel in the electron tube by one of the methods described in claims 11 to 18. This method realizes dense and homogeneous coating by precisely supplying the coating material to the nozzle while controlling fluctuations of pressure for supplying the coating material, so that a high low-reflection function or antistatic function can be imparted to the coated surface film.

EMBODIMENT 1

Figure 1:
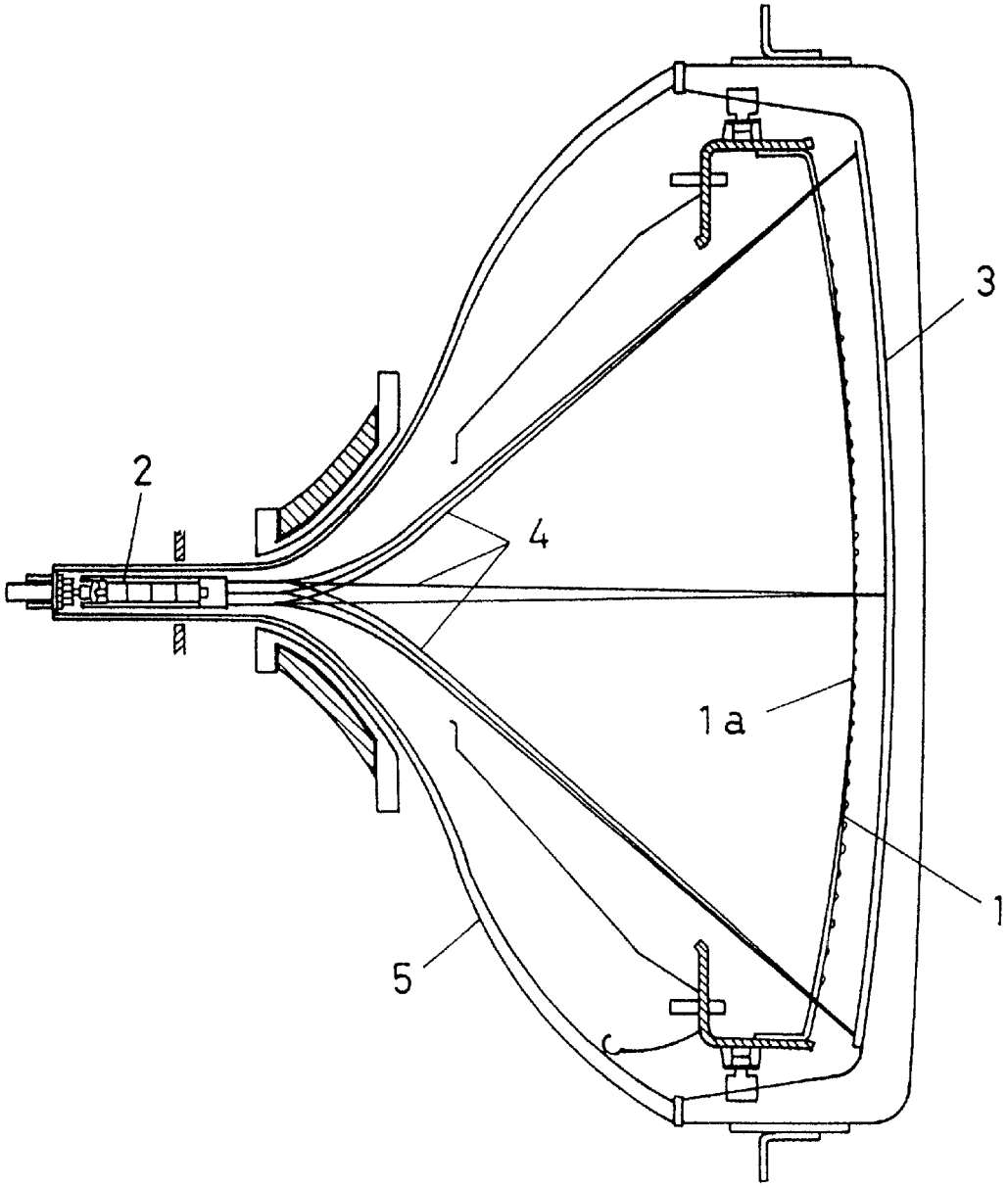
FIG. 1 is a configurational section view of a conventional electron tube.

A coating material containing bismuth oxide, water glass and water was dispersion-treated, to prepare a coating material for an electron beam reflecting film. Table 1 shows results of doming effect controlling assessments for shadow mask planes to be irradiated with electron beams, which are coated with the coating material containing bismuth particles having an average diameter D50 of 0.4 $\mu$m and varying volumetric distributions of the particles having diameters D40 to D60.

TABLE 1

| Volume distribution | Coated material weight (mg/cm$^2$) | | | | | | |
|---|---|---|---|---|---|---|---|
| of D40 to D60 | 0.5 | 0.4 | 0.3 | 0.2 | 0.15 | 0.1 | 0.05 |
| 50% | ○ | ○ | ○ | ○ | ◎ | ◎ | Δ |
| 30% | ○ | ○ | ○ | ○ | ◎ | ○ | Δ |
| 20% | ○ | ○ | ○ | ○ | ○ | ○ | X |
| 15% | XX | XX | XX | X | X | X | X |

X: No-good doming
XX: No-good opening clogging

Doming control effect was assessed by a deviation of electron beam on a fluorescent plane before and after thermal expansion of the shadow mask occurs. The electron beam deviation increases as the shadow mask thermally expands more. A deviation of 60 $\mu$m or less is taken as the standard to judge whether doming control effect is good or not, because no adverse effects on image quality are anticipated at such a travel. As shown in Table 1, good doming control effect and no defect with respect to opening of the mask clogging were observed, when the coating material has a volumetric distribution of the bismuth particles having diameters D40 to D60 for 20% or more and is 0.1 mg/cm$^2$ or more by weight. By contrast, the coating material having a volumetric distribution of D40 to D60 for less than 20% cannot give a dense coating film of high surface coverage because of uneven sizes of bismuth oxide particles in the coating material, causing a defective doming control effect when the coating material is less than 0.2 mg/cm$^2$ by weight. An attempt to obtain a higher doming control effect by increasing the coating material weight to 0.2 mg/cm$^2$ or more failed to give a coating film of good quality, because of clogging of the openings in the shadow mask.

These results indicate that the coating material having a volumetric distribution of D40 to D60 for 20% or more gives a dense electron beam reflecting film of high surface coverage, securing a high doming control effect even with a small quantity by weight of the coating material. As a result, high-quality images can be provided because no natural exfoliation occurs to the film.

Hi-visions and high-precision, large-size TV sets of stringent specifications require higher doming control effects. Further, because of reduced opening pitches, coating methods that cause no clogging of the shadow mask openings are needed. It is necessary to form a dense, electron beam reflecting film of high surface coverage with a small quantity by weight of the coating material for such TV sets of stringent specifications. It is preferable that the film is coated with a quantity by weight of the coating material of 0.1 to 0.2 mg/cm$^2$, as shown in Table 1.

Table 1 shows the results with the coating material having an average diameter D50 of 0.4 $\mu$m and containing the solids for 10%, but it is confirmed that the similar results are obtained with the coating materials having an average diameter D50 of 0.1 to 0.6 $\mu$m and containing the solids for 5 to 20%. Bismuth particles having an average diameter D50 of less than 0.1 $\mu$m may cause problems; e.g., they are sufficiently small to allow the electron beams to transmit through the particles more easily, decreasing the electron beam reflecting effect is decreased or causing exfoliated bismuth particles to fall onto the glass panel plane from the shadow mask openings, thereby threatening image quality to be deteriorated. The coating material containing solids for less than 5% may cause problems, e.g., it falls from the coated film more easily, because of an excessive content of water, making it difficult to spread a sufficient quantity by weight of the coating material to secure the sufficient doming control effect.

EMBODIMENT 2

A coating material containing bismuth oxide, water glass and water was dispersed by the centrifugal-force-field dispersion at a circumferential velocity of at least 30 m/s, to prepare a coating material for an electron beam reflecting film. The water glass worked as the binder to adhere bismuth oxide particles to a shadow mask. It normally comprises sodium, potassium or lithium silicate as main ingredient. The water glass of sodium silicate is used in Embodiment 2, because it has a higher adhesive power than the others.

Figure 2:
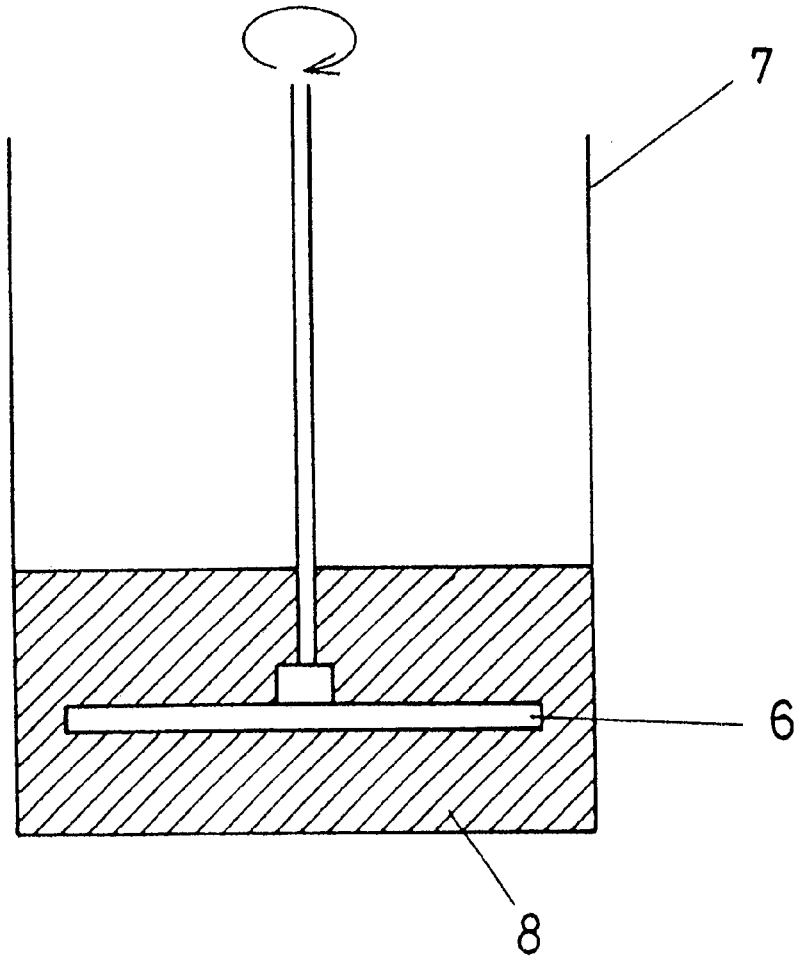
FIG. 2 shows a structure of a dispersion treating machine according to a second embodiment of the present invention.

A method for dispersing the coating material for an electron beam reflecting film is described by referring to the attached drawings. FIG. 2 shows a structure of a dispersion treating machine, wherein 6 is an agitating blade, 7 is a chamber, and 8 is the coating material. The coating material 8 was forced to adhere to the inner circumferential face of the chamber by dispersion treatment utilizing a centrifugal force provided by rotating the agitating blade 6 (hereinafter called centrifugal-force-field dispersion treatment). This method can disperse the coating material at a high circumferential velocity without any particular medium, so that a high energy efficiency is shown.

Table 2 shows average diameters of the bismuth oxide particles and pH levels of the coating material, when the coating material for the electron beam reflecting film containing bismuth oxide, water glass and water was dispersed by a sand mill or in a centrifugal field described above, where the average diameter means the D50 level determined by a laser diffraction type analyzer.

TABLE 2

| Method of dispersion treatment | Time elapsed | Average particle diameter | ph level |
|---|---|---|---|
| Sand milling | Immediately after dispersion | 0.4 μm | shifted to alkali side |
| | After 1 day | 0.7 μm | Shifted to alkali side |
| | After 2 day | 0.9 μm | Shifted to alkali side |
| Centrifugal-force-field dispersion | Immediately after dispersion | 0.4 μm | No change |
| | After 1 year | 0.4 μm | No change |

As shown in Table 2, the dispersion treatment using a sand mill causes the particles to agglomerate with each other immediately after the dispersion, increasing the average particle size and pH level, indicating unstable conditions of the coating material. On the other hand, the centrifugal-force-field dispersion causes no change in pH level, nor in average particle size even after it has been allowed to stand for one year after the dispersion.

Table 3 shows average particle diameters and pH levels of the coating materials which were dispersed at a varying circumferential velocity and allowed to stand for one year after the centrifugal-force-field dispersion.

TABLE 3

| Circumferential velocity (m/s) | Average particle diameter after 1 year | ph level |
|---|---|---|
| 20 | 0.5 μm increase | No change |
| 30 | No change | No change |
| 40 | No change | No change |
| 50 | No change | No change |

As shown in Table 3, increased average particle size was observed with the coating material dispersed by the centrifugal-force-field dispersion at a circumferential velocity of 20 m/s. But when the coating material was dispersed at a circumferential velocity of 30 m/s or more, no change was observed in average diameter or pH level even after it has been allowed to stand-for one year after the dispersion.

As a result, the coating material showing no deteriorated properties or particle agglomeration could be prepared by the centrifugal-force-field dispersion at a circumferential velocity of 30 m/s or more, securing stable discharge of the coating material without causing clogging inside the nozzle and piping system.

Figure 3:
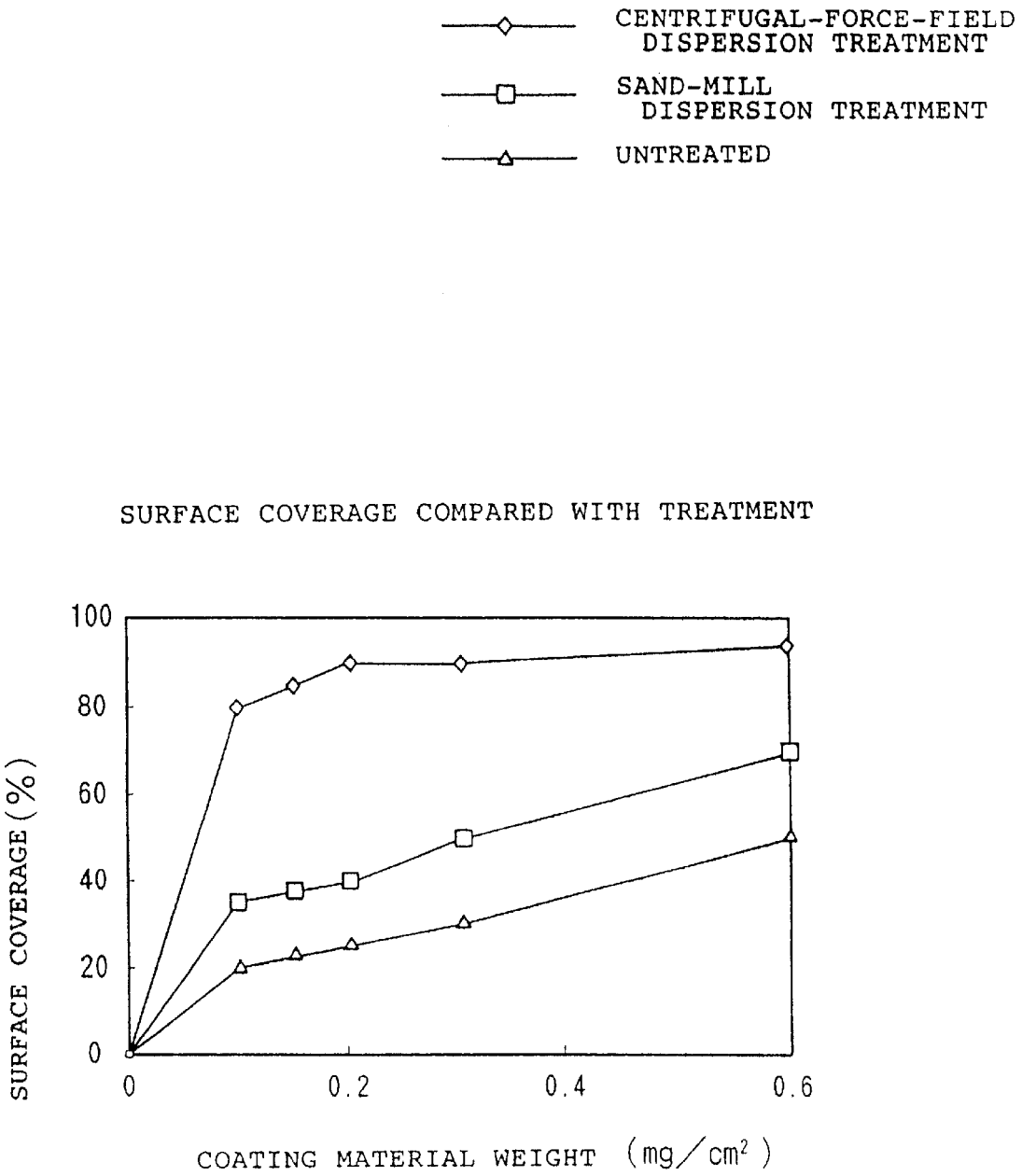
FIG. 3 shows the relationship between surface coverage of a film over a plane and coating-material treatment such as centrifugal-force-field dispersion or sand mill dispersion, or untreated case, according to the second embodiment of the present invention.

FIG. 3 shows the relationship of surface coverage of a film over a plane with respective coating-material treatments such as centrifugal-force-field dispersion, sand mill dispersion, or spray dispersion of untreated coating material. As shown in FIG. 3, the coating material gives a dense, homogenous film, when dispersed by the centrifugal-force-field dispersion, securing a higher surface coverage than that given when dispersed by the sand mill dispersion or the untreated coating material dispersion.

These results indicate that the coating material dispersed by the centrifugal-force-field dispersion gives a dense, electron beam reflecting film having high surface coverage of 80% or more with a small quantity by weight of the coating material of less than 0.2 mg/cm$^2$, securing high-quality images, because no natural exfoliation occurs to the film.

Table 4 shows the results of surface coverage of the films, coated with the coating materials each having a different average diameter dispersed by the centrifugal-force-field dispersion.

TABLE 4

| Particle diameter | Coated material weight (mg/cm$^2$) 0.1 | 0.15 | 0.2 | 0.4 | 0.6 |
|---|---|---|---|---|---|
| 0.2 μm | 80% | 85% | 90% | 90% | 90% |
| 0.4 μm | 80% | 85% | 90% | 90% | 90% |
| 0.6 μm | 80% | 80% | 85% | 90% | 95% |
| 0.8 μm | 65% | 70% | 70% | 75% | Opening clogging |
| 1.0 μm | 65% | 65% | 70% | 70% | Opening clogging |

※Solid content: 10%

As shown in Table 4, when the average particle diameter was 0.8 μm or more, increasing the coating material by weight in order to secure a high surface coverage of 80% or more caused the openings of the shadow mask to be clogged with the coating material. However, when average particle diameter was 0.6 μm or less, no clogging was observed in the openings was observed and a high surface coverage of 80% or more was obtained with a small quantity by weight of the coating material of less than 0.2 mg/cm$^2$. These are the results for the case where the coating material containing the solids for 10% is used, but it has been confirmed that the similar results are obtained when the content of solids is 20% or less.

These results indicate that the coating material containing the particles having an average diameter of 0.6 m or less gives an electron beam reflecting film of high surface coverage with a small quantity by weight of the coating material without causing clogging of the shadow mask openings, securing high-quality images because no natural exfoliation occurs to the film.

Table 5 shows the results of surface coverage of the films, coated with the coating materials each having a different solid content dispersed by the centrifugal-force-field dispersion.

TABLE 5

| Solid content | Coated material weight (mg/cm$^2$) 0.1 | 0.15 | 0.2 | 0.6 | 0.4 |
|---|---|---|---|---|---|
| 10% | 80% | 85% | 90% | 90% | 90% |
| 20% | 80% | 80% | 85% | 90% | 85% |
| 30% | clogging | clogging | clogging | Opening clogging | Opening clogging |
| 40% | clogging | clogging | clogging | Opening clogging | Opening clogging |

※Average particle diameter: 0.4 μm

As shown in Table 5, the nozzle and piping system were clogged with the coating material (as marked by "clogging" in Table 5) when the solid content was 30% or more, causing unstable discharge from the nozzle. Increasing the quantity by weight of the coating material by caused further clogging of the shadow mask openings. However, when the solid content was 20% or less, no clogging of the openings was observed and a high surface coverage of 80% or more was obtained with a small quantity by weight of the coating material of less than 0.2 mg/cm$^2$. These are the results for the coating material containing particles having an average diameter of 0.4 μm, but it has been confirmed that the similar results are obtained when the average diameter is 0.6 μm or less.

These results indicate that the coating material containing the solids for 20% or less gives a dense, electron beam reflecting film of high surface coverage with at a small quantity by weight of the coating material without causing clogging of the shadow mask openings, securing high-quality images because no natural exfoliation occurs to the film.

Table 6 shows the results of occurrence of exfoliation to the film with respect to the quantity by weight of the coating material dispersed by the centrifugal-force-field dispersion.

TABLE 6

| Coated material weight (mg/cm$^2$) | 0.1 | 0.15 | 0.2 | 0.4 | 0.6 |
|---|---|---|---|---|---|
| Image quality deterioration due to exfoliation | Good | Good | X | X | X |

X Average particle diameter: 0.4 $\mu$m, Solid content: 10%

As shown in Table 6, when the quantity by weight of the coating material is 0.2 mg/cm$^2$ or more, natural exfoliation occurs to the film because of excessive coating, causing image quality to be deteriorated. No natural exfoliation of the film nor deterioration of image quality was observed when the quantity by weight of the coating material was less than 0.2 mg/cm$^2$. These are the results for the coating material having a particle average diameter of 0.4 $\mu$m and a solid content of 10%, but it has been confirmed that the similar results are obtained when the average diameter is 0.6 $\mu$m or less and the content of solids is 20% or less.

These results indicate that natural exfoliation of the film on the shadow mask occurs when the quantity by weight of the coating material is 0.2 mg/cm$^2$ or more, because of excessive coating. But no natural exfoliation of the film nor deterioration of image quality occurs when the quantity by weight of the coating material is less than 0.2 mg/cm$^2$, because of the adequate quantity of the coating material. Therefore, coating the shadow mask with the coating material dispersed by the centrifugal-force-field dispersion with a quantity of less than 0.2 mg/cm$^2$ by weight of the coating material gives a dense, homogeneous, electron beam reflecting film of high surface coverage even with a small quantity by weight of the coating material, that is less than 0.2 mg/cm$^2$, securing high-quality images because no natural exfoliation occurs to the film.

EMBODIMENT 3

The same procedure as used for Embodiment 3 was repeated, except that a coating material containing bismuth oxide, alcoholate of silica and ethanol or methanol was used in place of the coating material containing bismuth oxide, water glass and water. The similar results were obtained.

EMBODIMENT 4

A coating material containing bismuth oxide, water glass and water was dispersed by the centrifugal-force-field dispersion to prepare a coating material for an electron beam reflecting film, and thus prepared coating material was spread over a shadow mask plane to be irradiated with electron beams, to form an electron beam reflecting film thereon.

Figure 4:
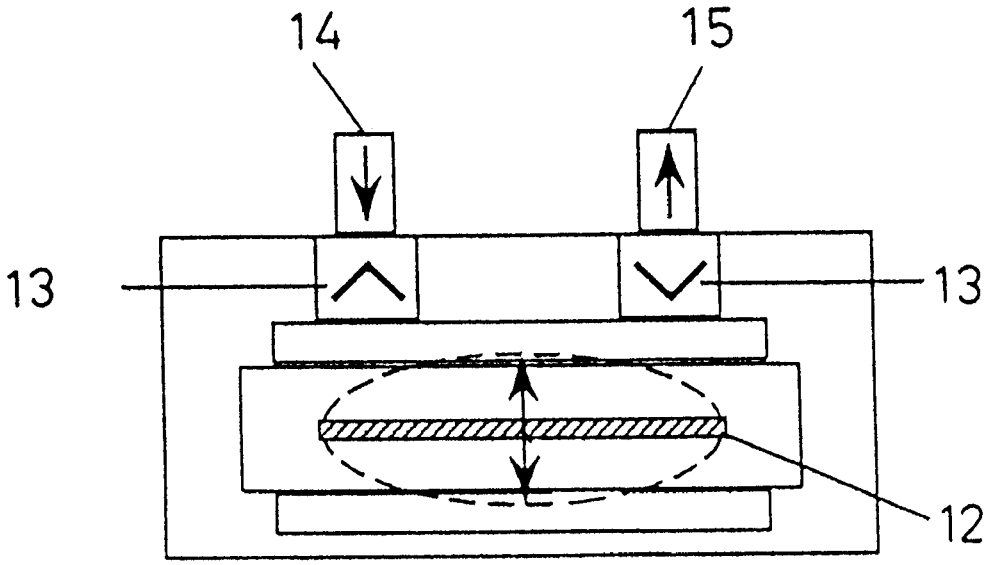
FIG. 4 is a configurational view of a piezoelectric pump according to a fourth embodiments of the present invention.

A spray coating device and a coating method of the electron beam reflecting film are described by referring to the attached drawings. FIG. 4 shows a structure of the piezoelectric pump, wherein 12 is a piezoelectric element, 13 is a check valve, 14 is a coating material inlet, and 15 is a coating material outlet. The piezoelectric element 12 was oscillated in the arrowed direction, to transfer the coating material from the inlet 14 to the outlet 15 while controlling pulsation of the coating material.

Figure 5:
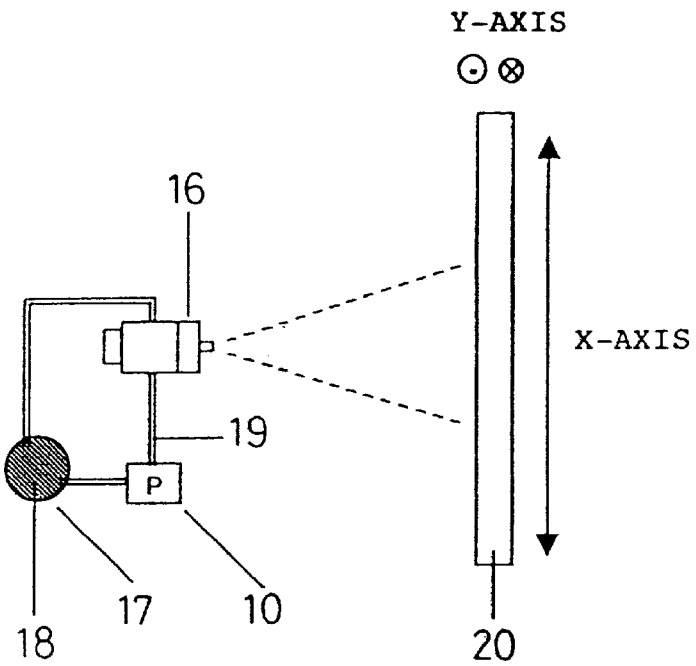
FIG. 5A is a configurational view of a spray-coating device according to the fourth embodiment of the present invention.
FIG. 5B is an alternative arrangement of the configuration shown in FIG. 5A.
Figure 5:
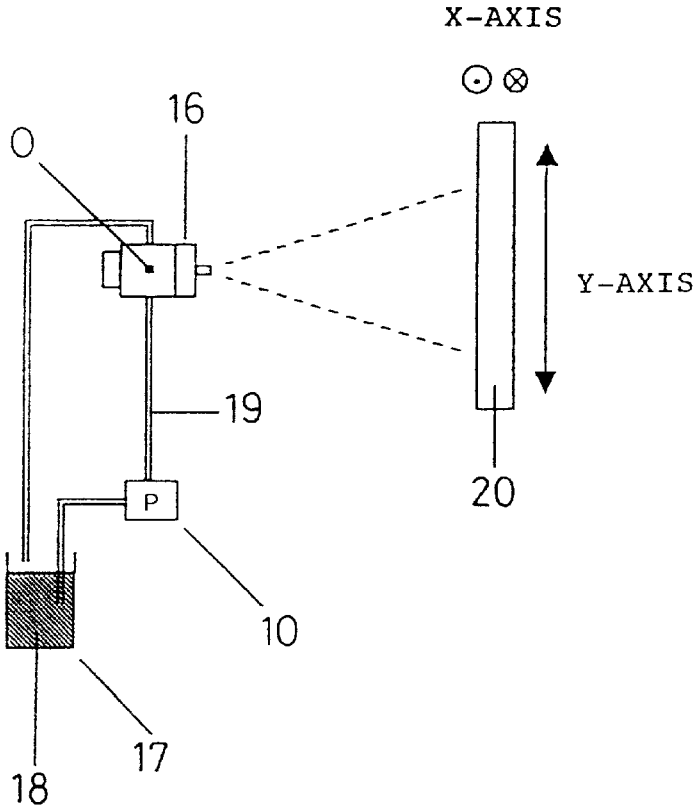

FIG. 5 shows a structure of the spray coating device, wherein 16 is a spray nozzle, 10 is a pump, 17 is a coating material storage section, 18 is a coating material, 19 is a recycling line, and 20 is a plane to be coated. The nozzle 16 was scanned in parallel to the plane 20 in the horizontal direction (X-axis) or vertical direction (Y-axis). The coating material 18, stored in the coating material storage section 17, was supplied to the spray nozzle 16 by the piezoelectric pump shown in FIG. 4, and spread over the shadow mask plane 20. Discharge of the coating material from the spray nozzle 16 was affected by fluctuations of pressure for supplying the coating material to the spray nozzle 16.

Table 7 shows ranges of fluctuations of the coating material supply pressure, and ranges of fluctuations of discharged quantity of the coating material from the spray nozzle as a result of the fluctuations of the supply pressure, for respective cases using a piezoelectric pump (operating at a frequency of 120 Hz) and conventional pumps.

TABLE 7

| Fluctuation range | Pump types | | |
|---|---|---|---|
| | Piezoelectric pump | Tube pump | Magnet pump |
| Fluctuation range of coating material supply pressure (kg/cm$^2$) | 0.005 | 0.063 | 0.034 |
| Fluctuation range of spray nozzle discharge quantity (ml/min) | 1 | 11 | 5 |

As shown in Table 7, the coating material supply pressure fluctuated largely when the conventional tube and magnet pumps were used, resulting in large fluctuations of discharged quantities of the coating material from the spray nozzle. By contrast, use of a piezoelectric pump could control supply pressure, stabilizing the discharged quantity from the nozzle.

The effect of an electron beam reflecting film, which is provided to prevent thermal expansion of a shadow mask when it is shot with electron beams, increases as an area covering the mask increases. However, if the quantity by weight of the coating material for the film increases, exfoliation of the film occurs inside an electron tube after it is produced, contaminating the electron tube and deteriorating the quality of images. Surface coverage and doming control effect were measured and compared, using the coating material of 0.3 mg/cm$^2$ as the standard. Doming control effect is assessed by the deviation of electron beam before and after thermal expansion of the shadow mask. The electron beam deviation increases as the shadow mask thermal expansion increases. A deviation of 60 $\mu$m or less is taken as the standard to judge whether the doming control effect is good, because with such deviation, adverse effects on the quality of images lessen.

Table 8 shows the results of the doming control effect with respect to each coated material weight of the coating material having the content of solids for 20%, for respective cases where a piezoelectric pump (operating at a frequency of 120 Hz) and conventional pumps are used to form an electron beam reflecting film on the shadow mask.

TABLE 8

| Coated material weight (mg/cm$^2$) | Pump types: Priezoelectric pump (120 Hz) | Tube pump | Magnet pump |
|---|---|---|---|
| 0.1 | X | X | X |
| 0.2 | Δ | X | X |
| 0.3 | ○ | X | X |
| 0.4 | ○ | X | Δ |
| 0.5 | ○ | X | ○ |
| 0.6 | ○ | Δ | ○ |

Table 9 shows the results of surface coverage and doming control effect for respective cases where a piezoelectric pump (operating at a frequency of 120 Hz) and conventional pumps are used to form an electron beam reflecting film on the shadow mask using the coating material having the content of solids for 20%, with 0.3 mg/cm$^2$ of coated material weight for each case.

TABLE 9

| Pump types | Physical properties: Surface coverage (%) | Doming control effect |
|---|---|---|
| Piezoelectric pump | 60 | ○ |
| Tube pump | 15 | X |
| Magnet pump | 20 | X |

As shown in Tables 8 and 9, even with such coated material weight that the conventional methods failed to bring a sufficient doming control effect, coating material discharge conditions can be stabilized by use of the piezoelectric pump, which contributes to forming a dense, homogeneous, electron beam reflecting film, thereby securing high-quality images.

TABLE 10

| Oscillation frequency (Hz) | Fluctuation ranges of spray nozzle discharge quantity (ml/min) | Doming control effect | Surface coverage (%) |
|---|---|---|---|
| 120 | 1 | ○ | 60 |
| 80 | 1 | ○ | 55 |
| 60 | 2 | ○ | 50 |
| 20 | 3 | ○ | 40 |
| 10 | 5 | X | 20 |

As shown in Table 10, the piezoelectric pump operating at a frequency of 20 Hz or more helped discharge the coating material in a narrower fluctuation range from the spray nozzle than did the conventional methods, thus increasing surface coverage with the same coated material weight and securing good doming control effect.

Figure 6:
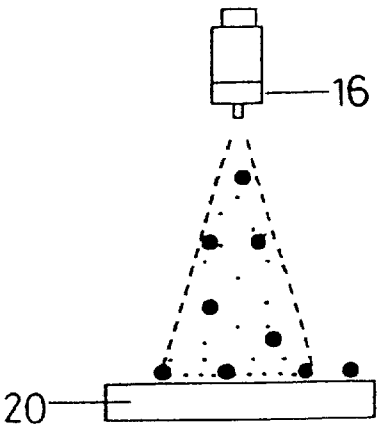
FIG. 6A shows a first relation between coating conditions and coating directions, according to the fourth embodiment of the present invention.
FIG. 6B shows a second relation between coating conditions and coating directions, according to the fourth embodiment of the present invention.
FIG. 6C shows a third relation between coating conditions and coating directions, according to the fourth embodiment of the present invention.
Figure 6:
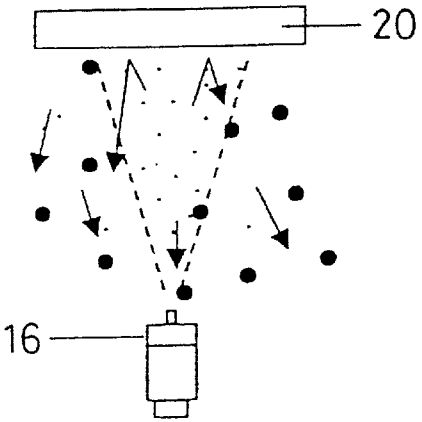
Figure 6:
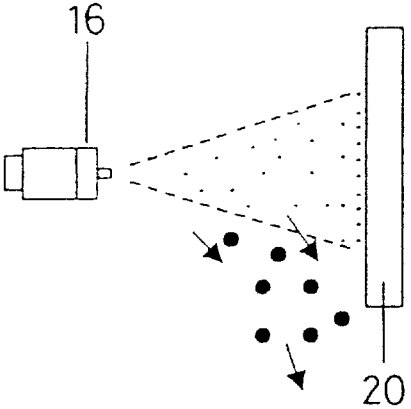

FIG. 6 shows three methods of spraying the coating material, respectively in the horizontal, upward and downward directions, onto the shadow mask plane 20 with 0.3 mg/cm$^2$ of the coating material by weight from the spray nozzle 16 to which the coating material was supplied by a piezoelectric pump operating at a frequency of 120 Hz.

The spray nozzle 16 atomized the coating material 18 by the aid of atomizing air, where the size of the atomized particles was not uniform but varied. When sprayed in the horizontal direction (a), the coarse and not well atomized particles fell down before reaching the plane 20, and only the fine and well atomized particles were spread over the plane The spray nozzle 16 atomized the coating material 18 by the aid of atomizing air, where the size of the atomized particles was not uniform but varied. When sprayed in the horizontal direction (a), the coarse and not well atomized particles fell down before reaching the plane 20, and only the fine and well atomized particles were spread over the plane 20, resulting in dense, homogeneous coating. When sprayed upward in the vertical direction (b), coarse particles which failed to reach the plane 20 and overly coated particles rebounded from the plane 20 fell onto the discharge port of the nozzle 16, causing contamination and clogging of the nozzle, making the discharged quantity unstable. When sprayed downward in the vertical direction (c), all of the atomized particles, regardless of size, fall onto the plane 20, leading to uneven coating, thicker with the coarser, not well-atomized particles and thinner with the finer particles.

Table 11 shows the results of beam deviation and surface coverage for respective cases where the coating material of 0.3 mg/cm$^2$ by weight was spray coated by the foregoing three methods. Table 12 shows the assessment standards for doming control effects under different beam deviations.

TABLE 11

| | Beam deviation (μm) | Surface coverage (%) |
|---|---|---|
| Horizontal coating | 52 | 60 |
| Upward vertical coating | 59 | 52 |
| Downward vertical coating | 57 | 57 |

Coated material weight: 0.3 mg/cm$^2$

TABLE 12

| | Beam deviation (μm) |
|---|---|
| Standards for normal type TV sets | 60 |
| Standards for Hi-vision TV sets | 55 |
| Standards for large-size (about 32 inches) TV sets | 50 |

Figure 7:
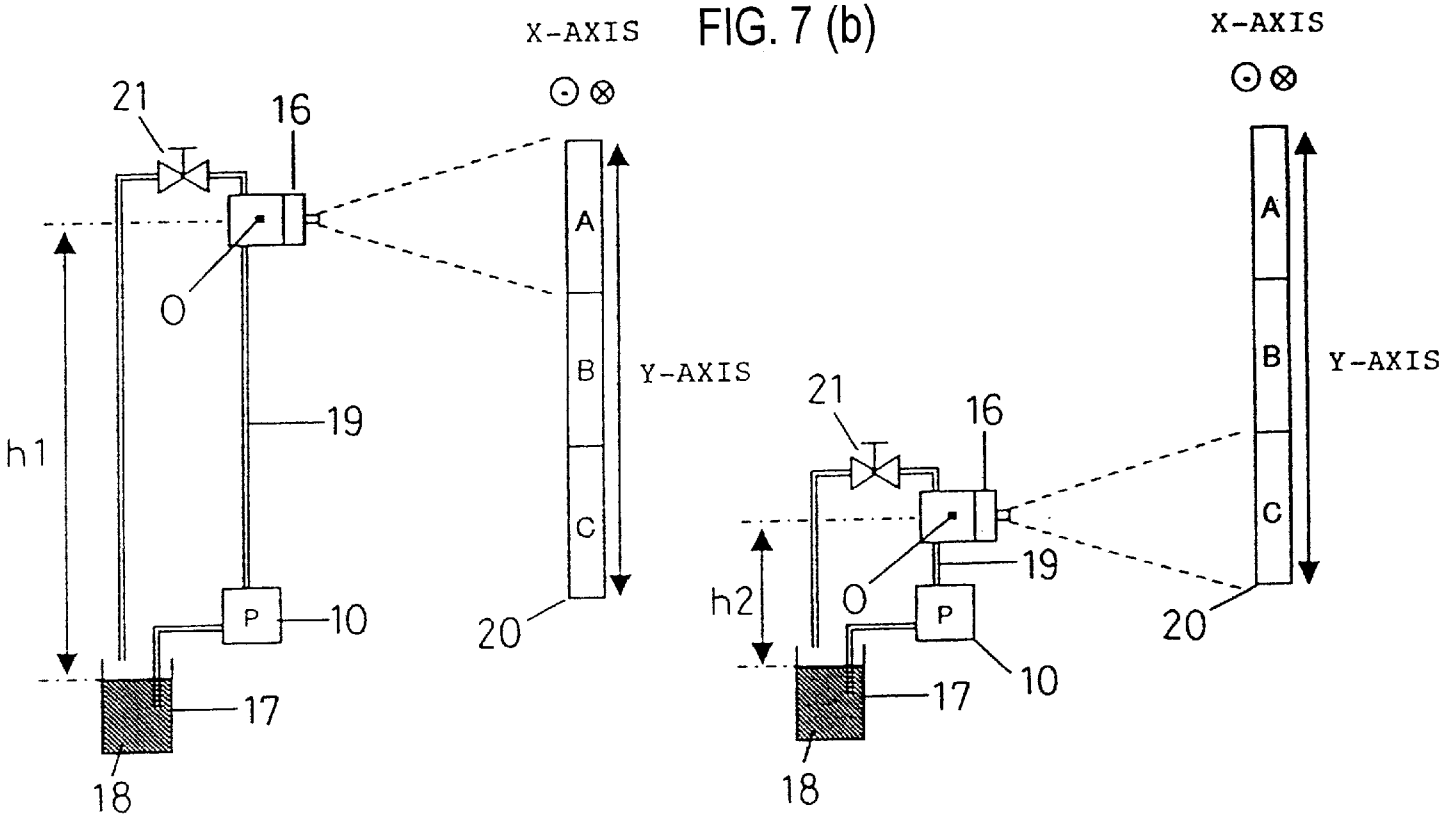
FIG. 7A is a configuration view of coating-material-supply pressure controlling systems, each equipped with a precision valve, according to the fourth embodiment of the present invention.
FIG. 7B is an alternative arrangement of the configuration shown in FIG. 7A.

As shown in Tables 11 and 12, all of the three spraying methods gave coatings which satisfy the standards for normal type TV sets, securing good doming control effects. However, the coatings formed by the upward and downward vertical spraying failed to satisfy the standard for Hi-vision TV sets. It is therefore preferable to use the horizontal spraying which gives a denser coating of higher surface coverage for Hi-vision TV sets of more stringent specifications. It is also preferable to provide a precision valve 21 in the coating material recycling line 19, as shown in FIG. 7, to control pressure for supplying the coating material to a nozzle 16 by opening the valve.

In the conventional system which uses no valve in the recycling line, coating material supply pressure is determined by the capacity of a pump used, and it is difficult to precisely control the supply pressure to a desired level, because controlling the supply pressure by discharge pressure of the pump is affected by flow characteristics of the pump and lacks stability. When a valve is provided in the recycling line 19, coating material supply pressure can be precisely controlled, without being affected by pump flow characteristics because of the discharge pressure of the pump 10 being kept constant, thereby realizing stable discharge of the coating material.

As discussed above, coating material supply pressure can be precisely controlled by precisely supplying the coating material 18 by a piezoelectric pump to the spray nozzle 16, and by providing a valve 21 in the recycling line 19 which recycles the coating material 18 back to a storage section 17 from the spray nozzle 16 to control pressure of the coating material to be supplied to the spray nozzle 16 and to realize stable discharge conditions, thereby contributing to forming a dense, electron beam reflecting film of high surface coverage and securing high-quality images.

EMBODIMENT 5

A coating material containing bismuth oxide, water glass and water was dispersed to prepare a coating material for an electron beam reflecting film, and thus prepared coating material was spread over a shadow mask plane to form an electron beam reflecting film thereon, in a manner similar to that of Embodiment 4.

Next, a spray coating device and a coating method for an electron beam reflecting film are described by referring to the attached drawings. A nozzle 16 is scanned only in the x-axis direction by the coating device shown in FIG. 5, wherein the nozzle was slanted at varying angles to keep unchanged a head h between the surface of the coating material in the coating material storage section 17 and the spray nozzle center o, to spray coat the coating material to form an electron beam reflecting film on a shadow mask plane as shown in FIG. 8.

The coating method 1 shown in FIG. 7 represents a conventional method, wherein the spray nozzle 16 is moved vertically in both directions to spray coat the coating material over the shadow mask plane 20. The nozzle 16 is scanned in both X- and Y-axis directions, and the head between the surface of the coating material in the coating material storage section and the nozzle center changes as the nozzle moves vertically, to change pressure for supplying the coating material to the spray nozzle. As a result, the shadow mask is coated thinly in the upper section and thickly in the lower section.

Figure 8:
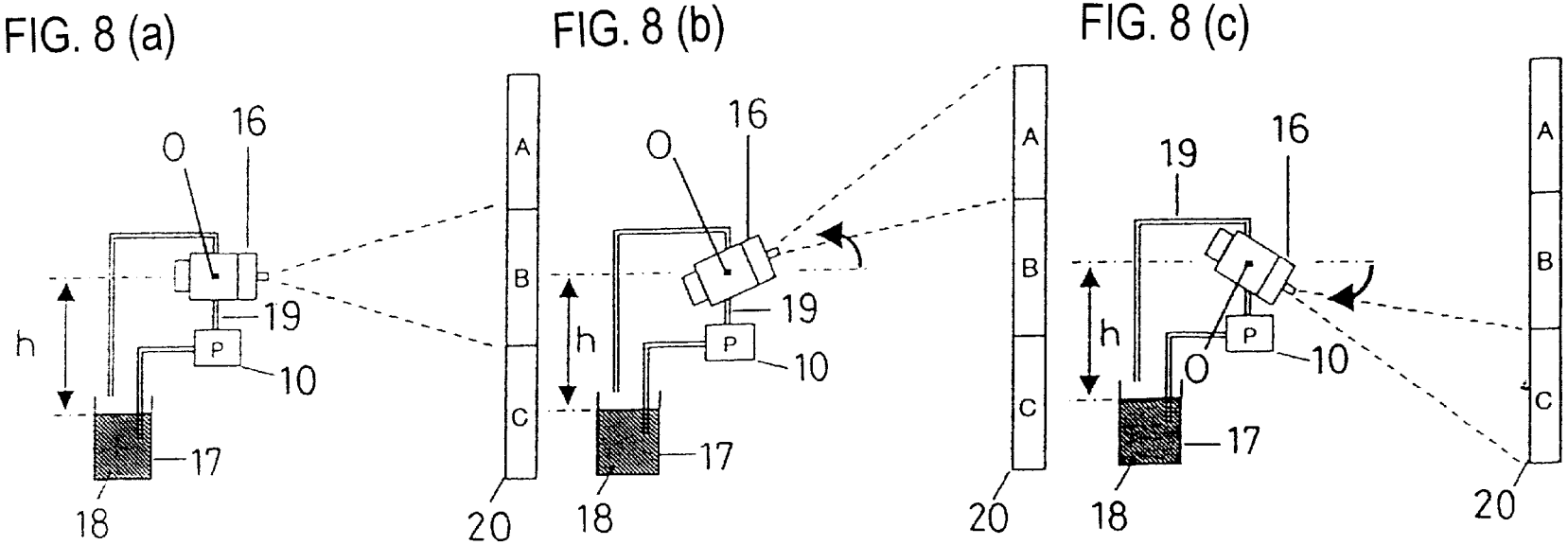
FIG. 8A shows coating methods, wherein a nozzle is slanted at a first angle to keep a constant head between the surface of a coating material and a nozzle, according to a fifth embodiment of the present invention.
FIG. 8B shows coating methods, wherein a nozzle is slanted at a second angle to keep a constant head between the surface of a coating material and a nozzle, according to a fifth embodiment of the present invention.
FIG. 8C shows coating methods, wherein a nozzle is slanted at a third angle to keep a constant head between the surface of a coating material and a nozzle, according to a fifth embodiment of the present invention.

The coating method 2 shown in FIG. 8 spray coats the coating material, wherein the nozzle is slanted vertically to keep a head h between the surface of the coating material in the coating material storage section and the nozzle center (i.e., the nozzle is scanned only in the X-axis direction). According to this method, the pressure for supplying the coating material is kept constant, unlike the coating method 1, because the head h between the surface of the coating material in the coating material storage section and the nozzle center o is kept unchanged.

Table 13 shows fluctuations of coated material weight in the upper, middle and lower sections (A, B and C shown in FIGS. 7 and 8, respectively) of the shadow mask planes coated by the foregoing methods 1 and 2. Surface coverage is also shown for each coated plane.

TABLE 13

| Coating method | Spray nozzle level | Spray nozzle angle | Fluctuations of coated material weight (in A, B and C) | Surface coverage |
|---|---|---|---|---|
| Method 1 | Vertical change | Unchanged | 0.3 mg/cm$^2$ ± 15% | 15% |
| Method 2 | Unchanged | Vertical change | 0.3 mg/cm$^2$ ± 4% | 60% |

Pressure for supplying the coating material to the spray nozzle 16 can be kept unchanged by scanning the nozzle only in the X-axis direction while slanting the nozzle at varying angles and keeping unchanged the head h between the surface of the coating material in the coating material storage section and the nozzle center o. This allows stable discharge of the coating material from the nozzle with minimized fluctuations of the coated material weight, thereby contributing to forming a dense, electron beam reflecting film of high surface coverage and securing high-quality images.

The results obtained by Embodiment 4 indicate that the horizontal coating is a preferable method for forming an electron beam reflecting film for TV sets of stringent specifications, e.g., Hi-vision TV sets. A larger-size TV set having a screen size of 32 inches or more, needs a larger shadow mask area, so that the required standard specifications are more stringent than those for a Hi-vision TV set. A desirable coating method to satisfy the above most stringent standard specifications is the one which scans the nozzle only in the X-axis direction while slanting the nozzle 16 at varying angles and keeping unchanged the head h between the surface of the coating material in the coating material storage section and the nozzle center o. It is preferable to scan the nozzle while keeping constant the positional relation between the pump 10 and nozzle 16 by integratedly assembling them such that the center of the pump is identical with the center of the nozzle, in order to control fluctuations of pressure for supplying the coating material to the nozzle 16. Such fluctuations are caused by changes in distance between the pump and the nozzle and in the head therebetween. It is also preferable to install a precision valve 21 in the recycling line 19, to more precisely control pressure for supplying the coating material to the nozzle 16 by controlling the opening of the valve. Coated material weight can be precisely controlled by these arrangements, realizing provision of a dense, homogeneous coating film which satisfies the most stringent standard specifications (see FIG. 9). Table 14 shows the results of beam deviation and surface coverage obtained with the coated material weight of 0.3 mg/cm$^2$ by the coating method shown in FIG. 9.

TABLE 14

| | Beam deviation (μm) | Surface coverage (%) |
|---|---|---|
| Same level Changing nozzle angle Coating by integration assembly of nozzle and pump | 48 | 83 |

Coated material weight: 0.3 mg/cm$^2$

Figure 9:
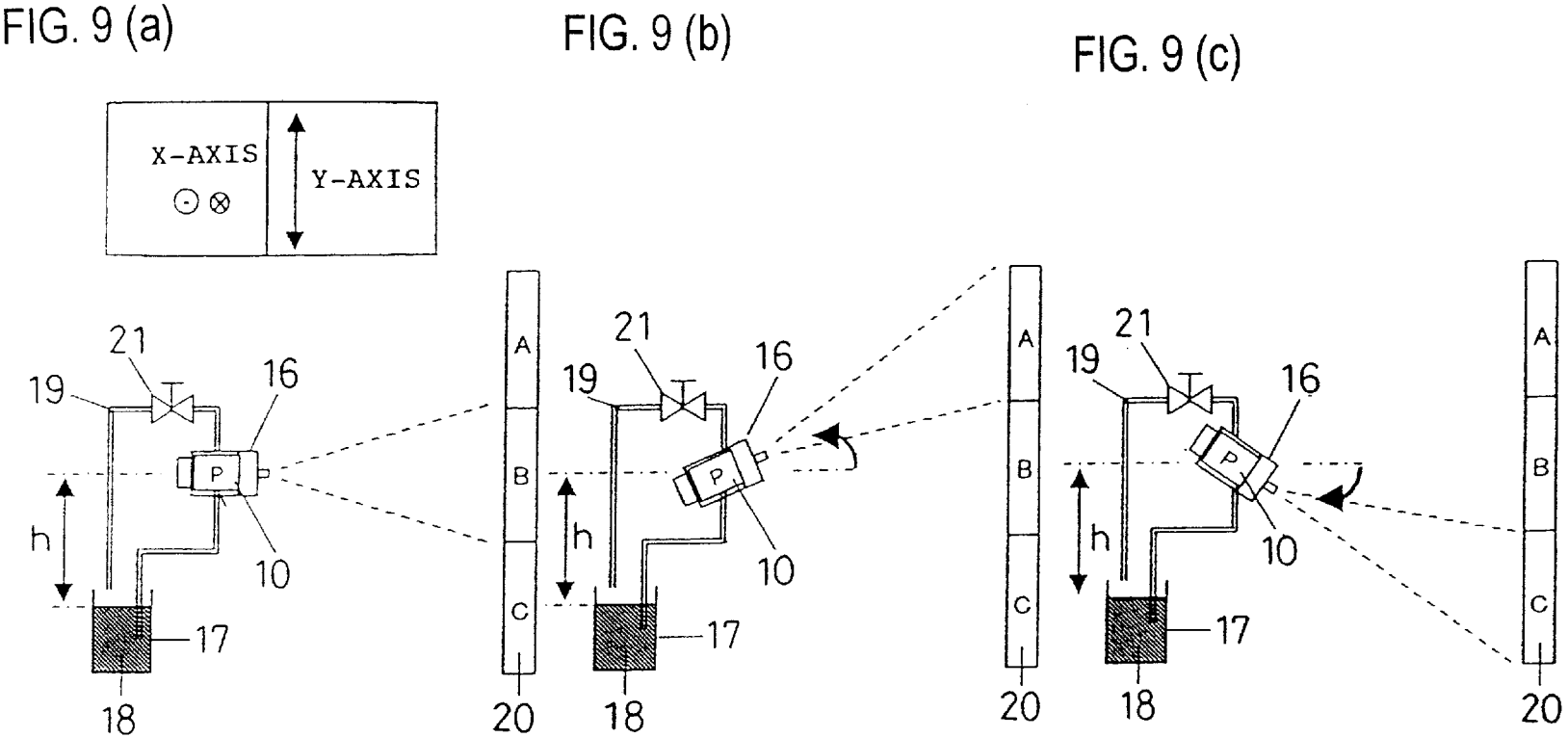
FIG. 9A shows a first alternative configuration of coating systems in which a pump and nozzle are assembled integratedly, according to the fifth embodiments of the present inventions
FIG. 9B shows a second alternative configuration of coating systems in which a pump and nozzle are assembled integratedly, according to the fifth embodiments of the present invention.
FIG. 9C shows a third alternative configuration of coating systems in which a pump and nozzle are assembled integratedly, according to the fifth embodiments of the present invention.

The coating method shown in FIG. 9 gives a dense, homogeneous electron beam reflecting film of high surface coverage (shown in Table 12) which can satisfy the most stringent standard specifications for a large-size TV set, thus securing high-quality images.

EMBODIMENT 6

The same procedure as used for Embodiment 5 was repeated, except that bismuth oxide and water were replaced by $SiO_2$ or ITO, to form a surface coat film. This method also allowed the coating material to be discharged stably, to give a surface coat film having a high low-reflecting function or antistatic function by effecting dense, homogeneous coating.

In accordance with the teaching of the present invention to produce an electron tube, described in Embodiments 1 through 6, an electron beam reflecting film of high surface coverage can be formed by spreading a small quantity by weight of the coating material which contains bismuth oxide particles having an average particle diameter D50 of 0.6 $\mu$m or less, and a particle size distribution with the particles having a diameter between D40 and D60 accounting for 20% or more by volume, to give a good electron tube with an electron beam reflecting film exhibiting a high doming control effect and causing no natural exfoliation.

Fluctuations of pressure for supplying the coating material to the spray nozzle can be controlled by the method which precisely supplies the coating material to the spray nozzle by high-frequency oscillation of a piezoelectric element and scans the nozzle while slanting it at varying angles to keep unchanged the head between the surface of the coating material in the coating material storage section and the nozzle center. As a result, stable discharge of the coating material can be realized and a dense, homogeneous electron beam reflecting film can be formed. Thus, with a small quantity by weight of the coating material, this method can give an electron beam reflecting film having high surface coverage, exhibiting high doming control effect and causing no natural exfoliation, thereby providing a preferable good electron tube.

A similar coating method is applicable to production of a surface coat film by dense, homogeneous coating, wherein the coating material is coated over a glass panel to form a surface coat layer having a high low-reflecting function or antistatic function.

What is claimed is:

1. A coating method employing a device having a nozzle located adjacent a to-be-coated plane for coating the plane by scanning the nozzle, the method comprising:

providing a volume of coating material in a coating material storage section;

supplying the coating material to the nozzle from a piezoelectric pump utilizing oscillations of a piezoelectric element contained therein, and coating a panel which is substantially coplanar with said plane by vertically orienting the nozzle at varying angles around a nozzle center of rotation and vis-a-vis the plane without varying a difference in height between the surface of the coating material in the coating material storage section and the nozzle center.

2. The coating method according to claim 1, wherein the center of the piezoelectric pump is identical with the center of the nozzle, the method comprising coating a panel by scanning the nozzle without varying a difference in height between the piezoelectric pump and the nozzle.

3. A coating method according to claim 1, wherein coating the panel comprises scanning the nozzle in the horizontal direction in parallel to a plane to be coated.

4. A coating method according to claim 1, wherein the nozzle comprises a spray nozzle.

5. The coating method according to claim 1, wherein the panel is a shadow mask for an electron tube, and coating a panel comprises coating the shadow mask with a coating material to form an electron beam reflecting film thereon.

6. The coating method according to claim 1, wherein the panel is a glass panel surface of an electron tube, and coating a panel comprises coating the glass panel surface with a coating material for imparting a low-reflecting function or antistatic function to the panel.

7. A coating method according to claim 1, wherein the piezoelectric element is actuated at an oscillation frequency of at least 20 Hz for generating oscillations for supplying the coating material to the nozzle.

8. A coating method according to claim 7, the device additionally comprising a coating material recycling line comprising a precision valve, and supplying the coating material to the nozzle comprises controlling pressure by adjusting an opening of the valve.

* * * * *